US007413015B2

(12) United States Patent
McKinnon et al.

(10) Patent No.: US 7,413,015 B2
(45) Date of Patent: Aug. 19, 2008

(54) PERFORATING GUN

(75) Inventors: Russell McKinnon, Sugar Land, TX (US); Daniel C. Markel, Pearland, TX (US); James E. Brooks, Manvel, TX (US); Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 252 days.

(21) Appl. No.: 11/161,937

(22) Filed: Aug. 23, 2005

(65) Prior Publication Data

US 2007/0044968 A1 Mar. 1, 2007

(51) Int. Cl.
*E21B 43/117* (2006.01)

(52) U.S. Cl. ..... 166/297; 166/55.2

(58) Field of Classification Search ..... None
See application file for complete search history.

(56) References Cited

U.S. PATENT DOCUMENTS 2,796,023 A * 6/1957 Abendroth ..... 175/4.52
4,105,073 A * 8/1978 Brieger ..... 166/286
4,756,371 A * 7/1988 Brieger ..... 166/312
4,919,050 A 4/1990 Dobrinski et al.
6,460,463 B1 10/2002 Parrott et al.
6,523,474 B2 2/2003 Parrott et al.
6,672,405 B2 1/2004 Tolman et al.

* cited by examiner

*Primary Examiner*—Zakiya W. Bates
(74) *Attorney, Agent, or Firm*—Trop, Pruner & Hu, P.C.; Kevin B. McGoff; Bryan P. Galloway

(57) ABSTRACT

A system and method of generating one or more perforations in a well casing while simultaneously restricting burr formation is provided. A perforating gun assembly includes a gun housing having an outer surface designed to engage the inner surface of the well casing. At least a portion of the outer surface of the gun housing substantially corresponds to the inner surface of the well casing. The position of the gun housing engaging the inner surface of the well casing restricts burr formation both upon the inner surface of the well casing and the outer surface of the gun during explosive charge detonation.

12 Claims, 6 Drawing Sheets

PERFORATING GUN

FIELD OF THE INVENTION

The present invention relates generally to well operations and, more particularly, to a perforating gun.

BACKGROUND OF THE INVENTION

A perforating gun may be lowered into the well and detonated to pierce a well casing and form fractures in the formation. After the perforating gun detonates, well fluid typically flows into the casing and to the surface of the well via production tubing located inside the well casing.

SUMMARY OF THE INVENTION

The present invention provides a system and method of generating one or more perforations in a well casing while simultaneously suppressing burr formation. In one embodiment, the present invention provides a perforating gun capable of being lowered into a well casing. The perforating gun provides a gun housing having an outer surface capable of engaging the inner surface of the well casing. In one embodiment, at least a portion of the outer surface of the gun housing has a diameter substantially equal to the diameter of the inner surface of the well casing.

Through use of an orienting tool, this portion of the gun housing may be positioned to engage the inner surface of the well casing prior to explosive charge detonation. The mass and surface area of the gun housing up against the inner surface of the well casing restricts burr formation both upon the inner surface of the well casing and the outer surface of the gun during explosive charge detonation. In one embodiment, explosive charges are positioned to correspond with the portion of the gun housing designed to engage the inner surface of the well casing.

In another embodiment, the outer surface of the gun housing may be equipped with one or more bow springs. In one embodiment, the outer surface of each bow spring has a diameter substantially equal to the diameter of the inner surface of the well casing. This feature of the present invention allows the bow spring to engage the inner surface of the well casing prior to and during explosive charge detonation. During detonation, the bow spring acts as a sacrificial target and restricts burr formation upon the inner surface of the well casing.

In another embodiment, the present invention provides a sleeve designed for attachment to the outer surface of the gun housing. In one embodiment, the sleeve of the present invention is designed to conform to the inner surface of the well casing. In another embodiment, the sleeve is composed of an inflatable material capable of expanding to engage the inner surface of the well casing prior to and during detonation. Further, the sleeve is capable of retracting to facilitate the removal of the gun housing from the well casing after detonation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings; it being understood that the drawings contained herein are not necessarily drawn to scale; wherein.

DETAILED DESCRIPTION OF THE INVENTION

Figure 1A:
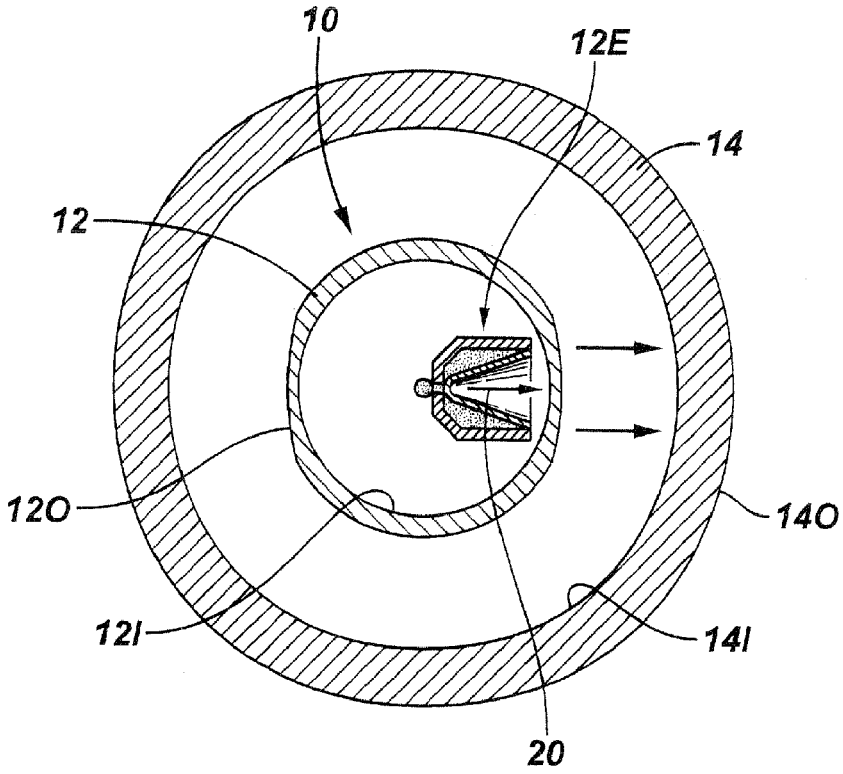
FIGS. 1A-1B are plan views illustrating the perforating gun of a first embodiment of the present invention interacting with the inner surface of a well casing.
Figure 1B:
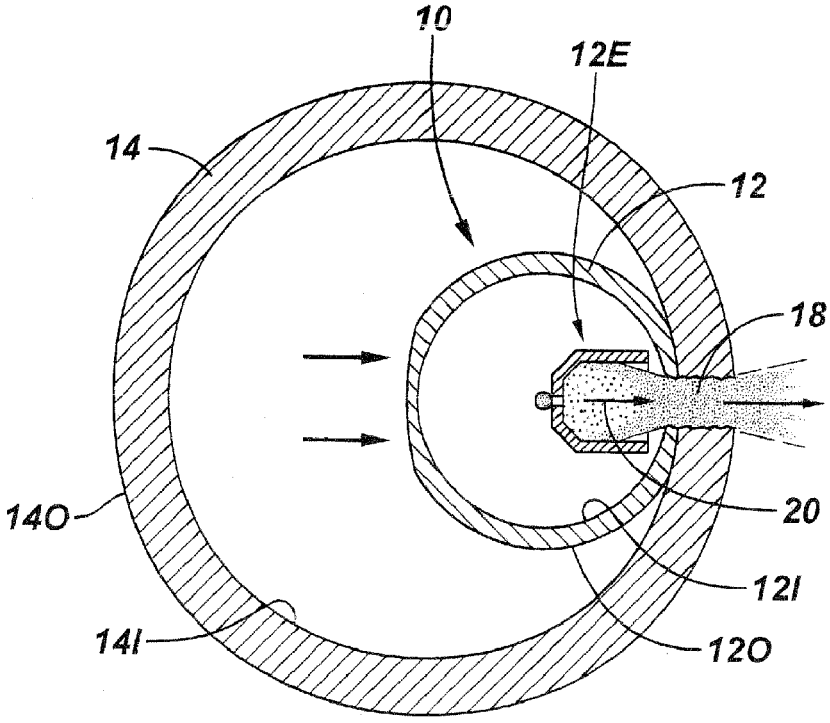
Figure 2A:
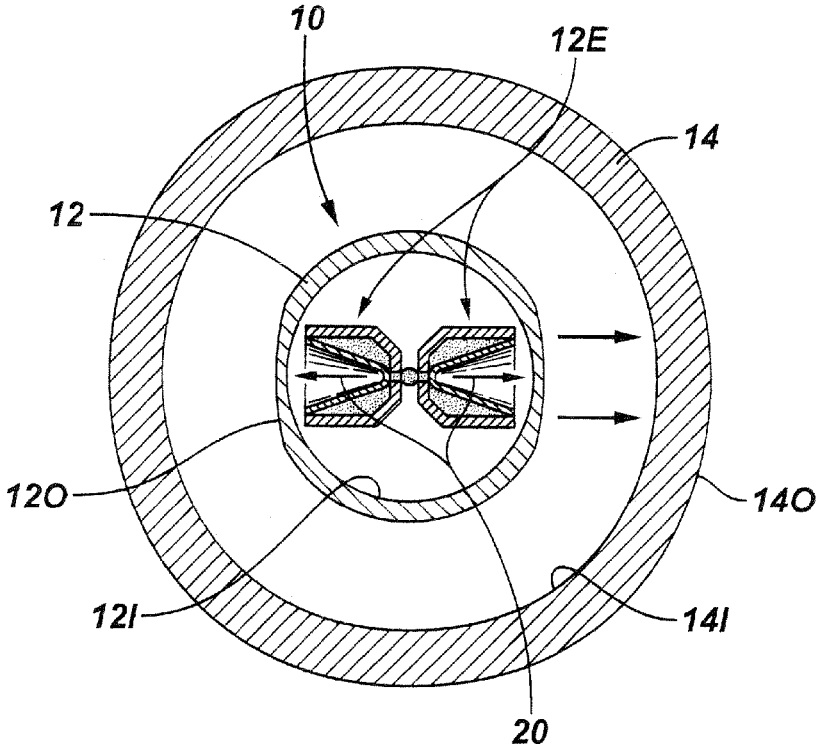
FIGS. 2A-2C are plan views illustrating the perforating gun of a second embodiment of the present invention interacting with the inner surface of a well casing.
Figure 2B:
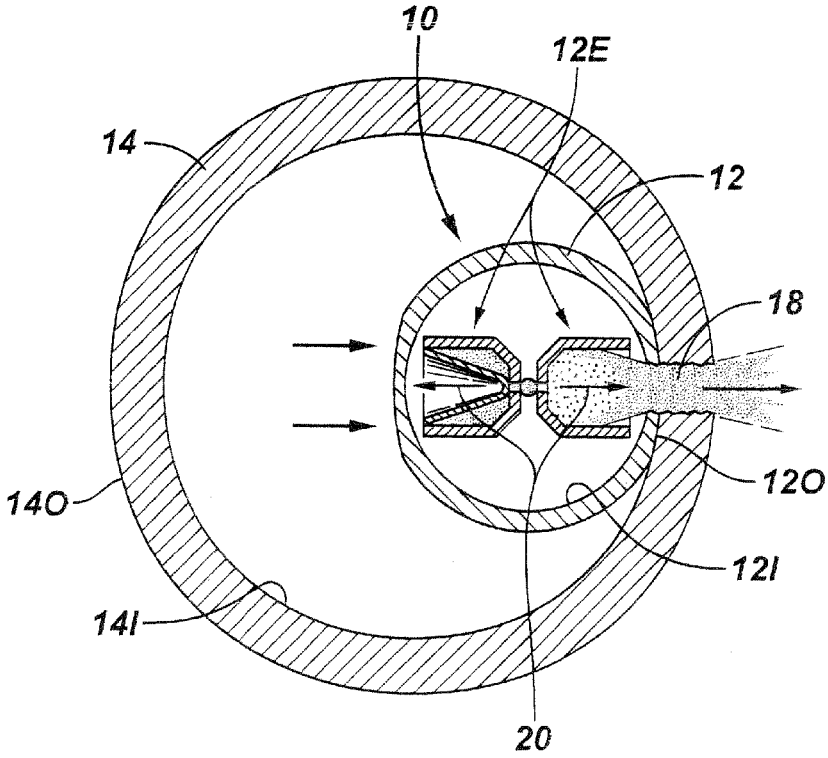
Figure 2C:
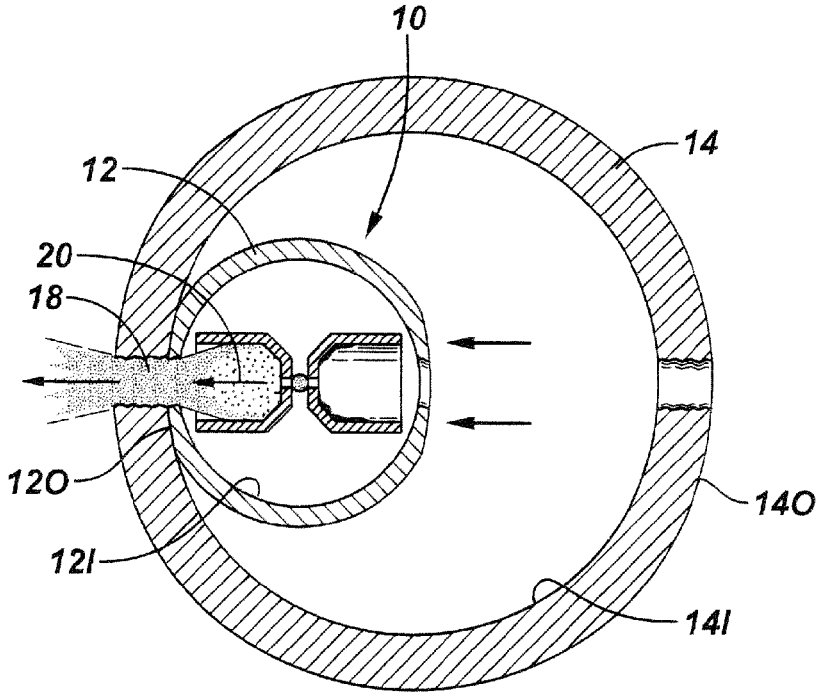

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

The invention is herein described as a perforating gun for generating one or more perforations through a well casing and as a method of suppressing burr formation during well casing perforation.

Referring to the Figures, the present invention provides a perforating gun (10) having a gun housing (12). The gun housing contains one or more explosive charges (12E) for use in perforating the well casing (14). The gun housing has a generally cylindrical configuration having inner and outer surfaces (12I and 12O, respectively).

Referring to FIGS. 1A-2C, in one embodiment, the outer surface (120) of the gun housing has a generally cylindrical configuration except in the area where the housing engages the inner surface (14I) of the well casing (14). This unique portion of the gun housing is designed to have substantially the same shape and/or configuration as the inner surface of the well casing. In one embodiment, the radius of a portion of the outer surface of the gun housing is increased to substantially correspond to the radius of the inner surface of the well casing.

The unique configuration of the outer surface of the gun housing allows for greater surface contact between the perforating gun (10) and the inner surface (14I) of the well casing (14) prior to and during detonation of the explosive charges (12E) held within the gun housing.

In one embodiment, the perforating gun of the present invention may be positioned within the well casing such that the explosive charges therein are aligned to detonate in the preferential stress direction (20) for fracturing. The perforating gun may be positioned within the well casing through use of any number of known orienting tools and/or techniques (not shown). Positioning the outer surface of the gun having the unique configuration against the inner surface of the well results in burr suppression during detonation of explosive charges in the preferential stress direction. In short, the mass of the perforating gun and the increased surface contact between the gun and the inner surface of the well casing suppresses burr formation.

Although FIGS. 1A-2C illustrate 0 degree and 0/180 degree phased arrangements through which charges may be deployed into the well casing, it should be understood that these figures are for example purposes only. Specifically, the unique geometric configuration of the outer surface of the gun housing may be utilized with any number of explosive charge alignments and/or phase arrangements. The unique geometry described above may be applied to multiple locations upon the perforating gun and/or gun housing to allow the invention maximum versatility.

Figure 3A:
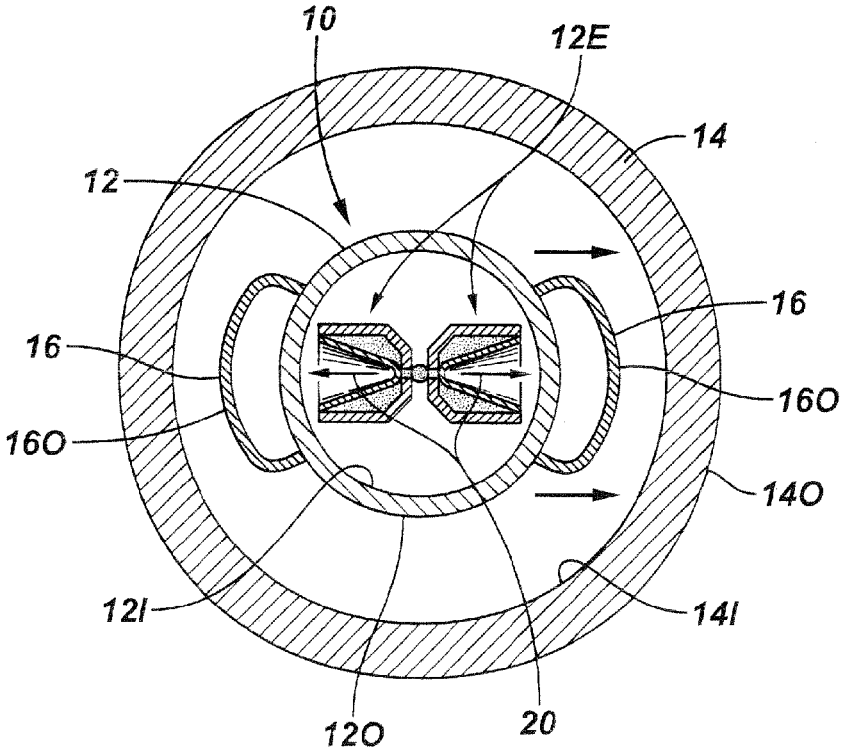
FIGS. 3A-3C are plan views illustrating the perforating gun of a third embodiment of the present invention interacting with the inner surface of a well casing.
Figure 3B:
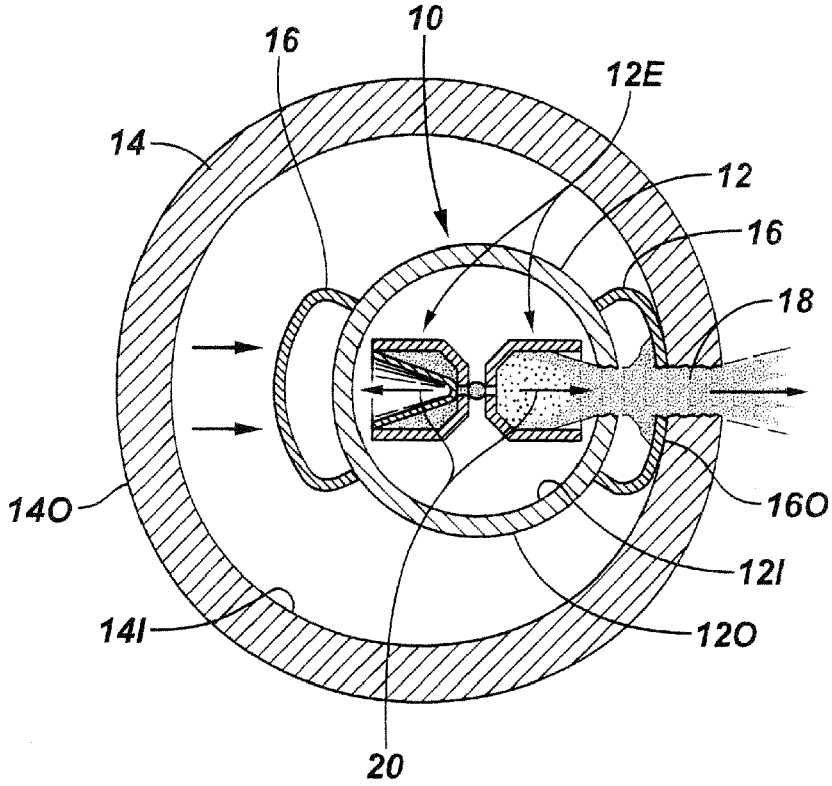
Figure 3C:
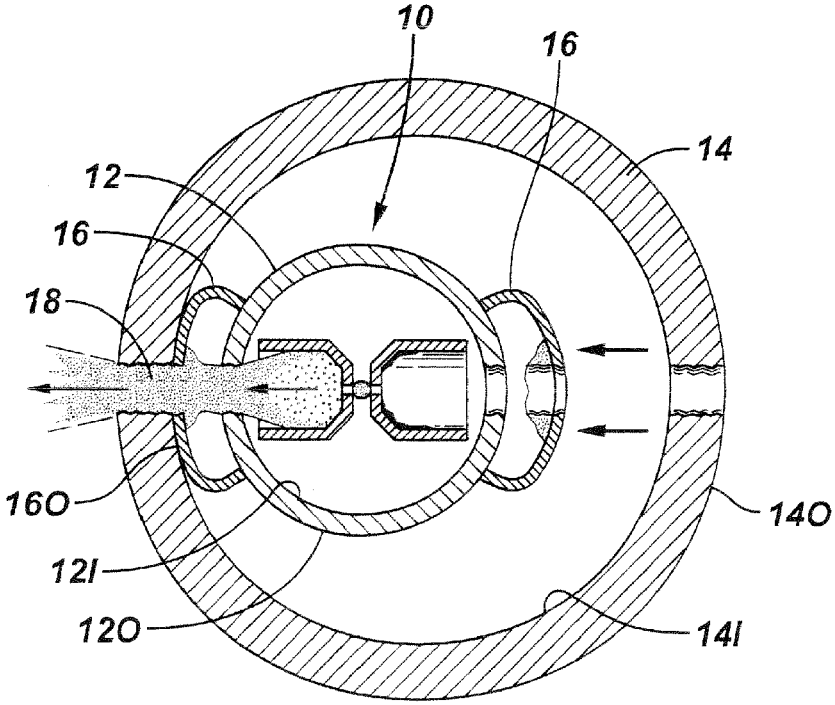

Referring to FIGS. 3A-3C, the perforating gun of the present invention may utilize one or more bow springs (16) alone or in conjunction with the unique geometric arrangement described above. In one embodiment, one or more bow springs (16) may be attached to the outer surface (12O) of the gun housing (12). In this embodiment, at least a portion of the outer surface (16O) of each bow spring (16) substantially corresponds to the inner surface (14I) of the well casing (14). This feature of the present invention allows at least a portion of the outer face of the bow spring to conform to the inner surface of the well casing in order to suppress burrs during explosive detonation.

The unique configuration of the outer surface of the bow spring allows for greater surface contact between the gun housing (10) and the inner surface (14I) of the well casing (14) prior to and during detonation of the explosive charges (12E) held within the gun housing. During detonation, the bow spring acts as a sacrificial target and suppresses burr formation upon the inner surface of the well casing. By suppressing burr formation on the inside of the well casing, the present invention allows other well completion tools, such as packers, to be conveyed past the perforations (18) in the well casing (14) without incurring damage.

In one embodiment, the perforating gun of the present invention may be positioned within the well casing such that the explosive charges therein are aligned to detonate in the preferential stress direction (20) for fracturing. In one embodiment, one bow spring is provided for each direction of explosive charge detonation. For example, if the perforating gun has a 0/180 degree phased arrangement, two bow springs may be utilized. In the case of spiral phasing, a bow spring having a spiral configuration may be utilized.

The perforating gun may be positioned within the well casing through use of any number of known orienting tools and/or techniques. Further, the explosive charges may be aligned/phased to enable the explosive charge to proceed from the gun housing, through the bow spring, and into the well casing.

Although FIGS. 3A-3C illustrate a 0/180 degree phased arrangement through which charges may be deployed into the well casing in opposite directions, it should be understood that the Figures are for example purposes only. Specifically, the unique geometric configuration of the outer surface of the bow springs may be utilized with any number of explosive charge alignments and/or phase arrangements. The unique geometry described above may be applied to multiple locations upon a perforating gun and/or gun housing to allow the invention maximum versatility.

Figure 4A:
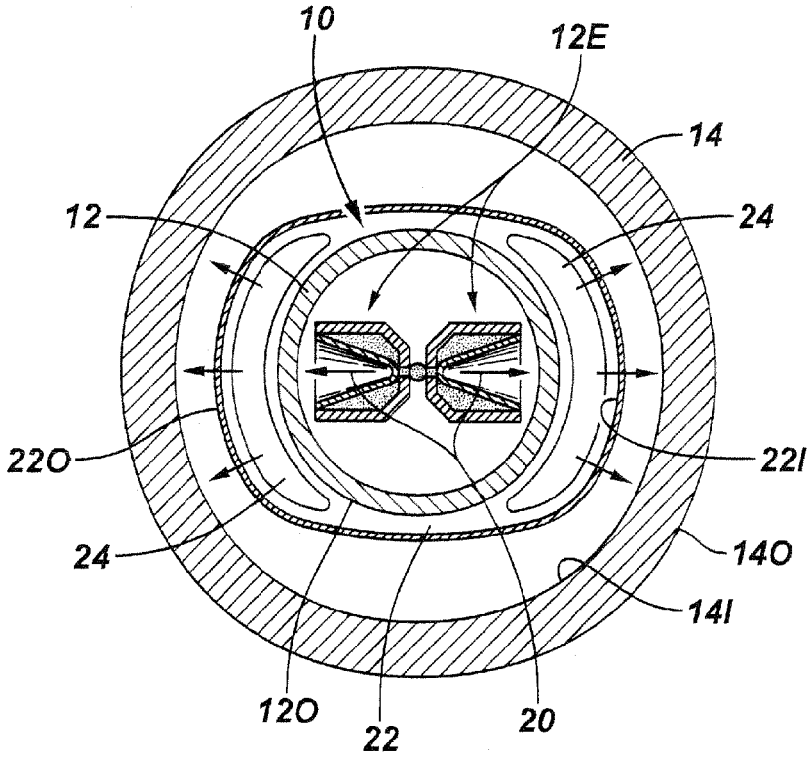
FIGS. 4A-4C are plan views illustrating the perforating gun of a fourth embodiment of the present invention interacting with the inner surface of a well casing.
Figure 4B:
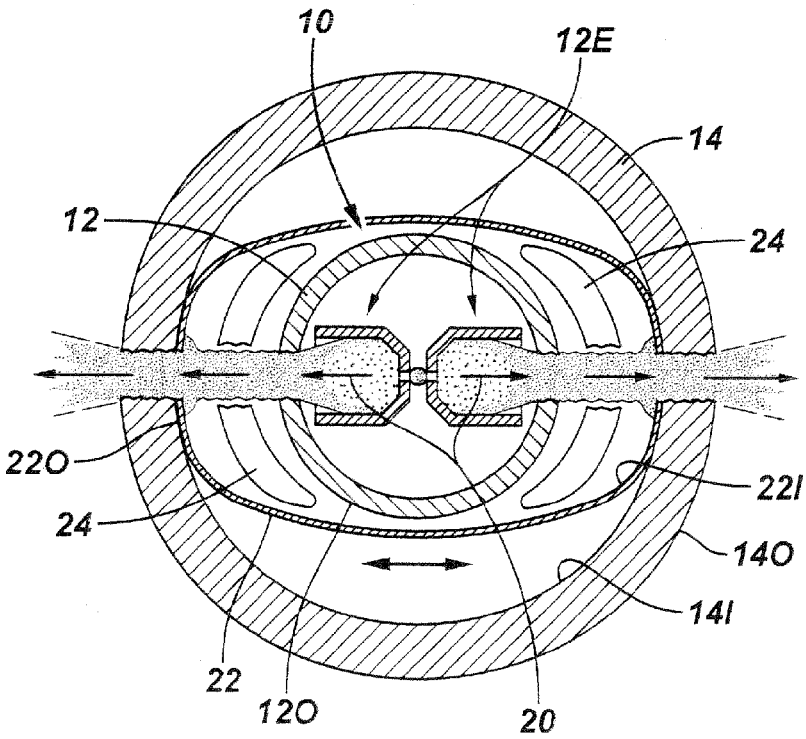
Figure 4C:
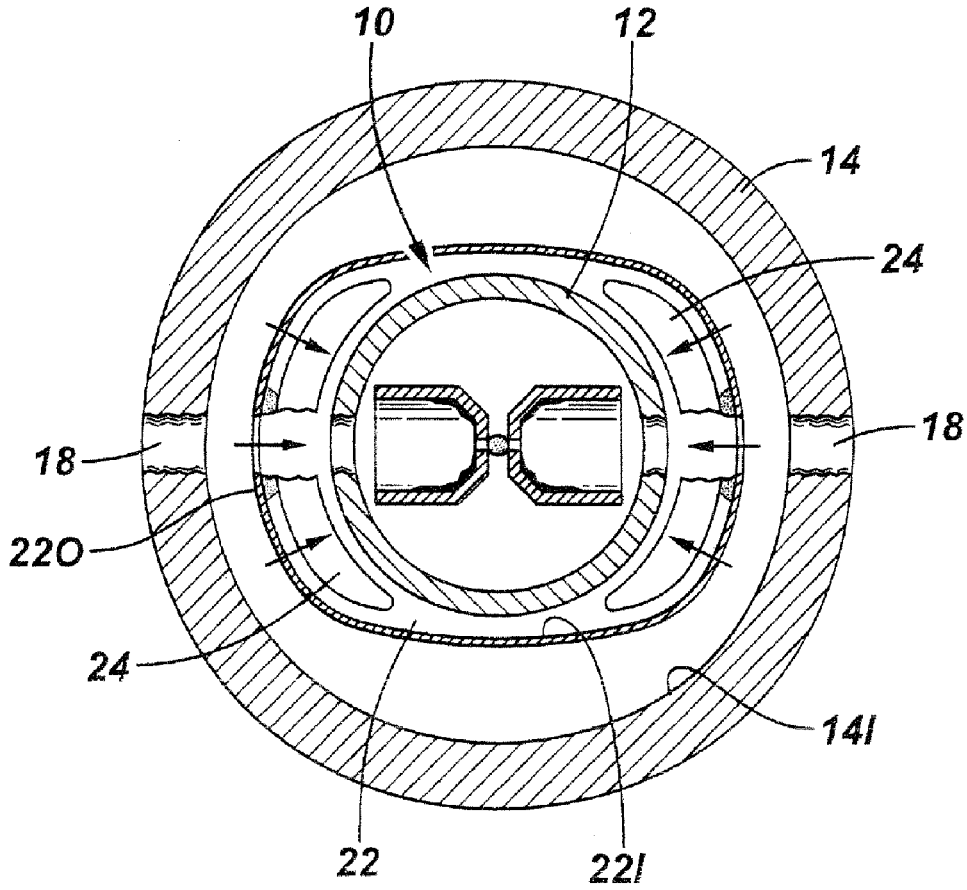

Referring to FIGS. 4A-4C, the perforating gun (10) of the present invention may utilize one or more external sleeves (22) alone or in conjunction with the features of the present invention described above. Such sleeve(s) may be attached to the housing (12) of the perforating gun (10) for insertion into the well casing (14).

In one embodiment, the purpose of the external sleeve is to centralize the perforating gun so that all explosive detonations are uniform in all directions. Further, the sleeve (22) is capable of providing a sacrificial target such that when the explosive charge penetrates the sleeve, a burr is created on the inside surface (221) of the sleeve (22) instead of upon the inside surface (14I) of the well casing (14).

The sleeve of the present invention is capable of expanding and contracting to the inner surface of the well casing. In one embodiment, the outer surface (22O) of the sleeve conforms to the inner surface of the well casing prior to and during explosive charge detonation in order to suppress burr formation on the inner surface of the well casing. In one embodiment, the sleeve of the present invention comprises a radial spring attached to the outer surface of the gun housing and capable of expanding and retracting according to the inner surface of the well casing during gun insertion and retraction. The radial spring may also be configured to provide one or more bypass slots to accommodate fluid flow through the well casing.

This feature of the present invention allows the perforating gun to be inserted downwardly into the well casing prior to explosive charge detonation, then withdrawn after detonation. By providing a sleeve capable of conforming to the inner surface of the well casing, the goal of suppression burr formation may be achieved.

As with the embodiments described above, the mass of the sleeve and the increased surface contact with the inside surface of the well casing suppresses formation of burrs during detonation. The sleeve may be composed of any material or combination of materials capable of conforming to the inner surface of the well casing and providing sufficient mass to suppress burr formation upon the inner surface of the well casing. The sleeve may be equipped with one or more bypass slots to allow for fluid bypass within the well casing. In one embodiment, bypass slots may be placed between shot planes.

In one embodiment, the sleeve may be filled with a fluid, i.e., a liquid or gaseous substance, to allow for controlled expansion and contraction. In one embodiment, the sleeve provides walls defining one or more cavities (24) capable of receiving fluids. This feature of the present invention allows the sleeve to be smaller than the area provided by the inner surface of the well easing for easy insertion and removal. In one embodiment, the sleeve of the present invention forms an air-tight seal with the outer surface of the gun housing. It understood that the sleeve may be unsealed as well.

Upon reaching the desired depth within the well casing, fluids may then be injected into the sleeve, i.e., as a propellant, causing the sleeve to expand and contact the inner surface of the well casing prior to and during explosive charge detonation. Once expanded, the sleeve acts as a burr suppression tool during detonation. In one embodiment, perforation of the sleeve during detonation causes the sleeve to deflate such that the sleeve may be withdrawn from the well casing. In one embodiment, perforating the sleeve results in an equalization of the internal pressure of the sleeve with internal pressure within the well casing. This feature of the present invention allows the perforating gun and the sleeve to be removed from the well casing after explosive charge detonation.

Although FIGS. 4A-4C illustrate a 0/180 degree phased arrangement though which charges may be deployed into the well casing in opposite directions, it should be understood that the Figures are for example purposes only. Specifically, the external sleeve of the present invention may be utilized with any number of explosive charge alignments and/or phase arrangements. The external sleeve may also be applied to multiple locations upon a perforating gun and/or gun housing to allow the invention maximum versatility.

Although the invention has been described with reference to specific embodiments, this description is not meant to be construed in a limited sense. Various modifications of the disclosed embodiments, as well as alternative embodiments of the invention, will become apparent to persons skilled in the art upon reference to the description of the invention. It is, therefore, contemplated that the appended claims will cover such modifications that fall within the scope of the invention.

What is claimed is:

1. A perforating gun for generating one or more perforations through a well casing comprising:

a gun housing containing one or more explosive charges, said gun housing having an outer surface, at least a portion of said outer surface substantially corresponding to an inner surface of said well casing, and the at least a portion of the gun housing outer surface shaped to enable surface contact between the at least a portion of the gun housing outer surface and the inner surface of said well casing, the one or more explosive charges to detonate through the at least a portion of the gun housing outer surface that is in surface contact with the inner surface of said well casing, wherein the surface contact is to suppress burr formation.

2. The perforating gun of claim 1, wherein the at least a portion of said outer surface of said gun housing is for engaging said inner surface of said well casing prior to explosive charge detonation.

3. The perforating gun of claim 1, wherein one or more of said explosive charges are configured to detonate through said at least a portion of said outer surface of said gun housing corresponding to said inner surface of said well casing.

4. The perforating gun of claim 1, wherein the at least a portion of the gun housing outer surface is shaped to enable greater surface contact between the at least a portion of the gun housing outer surface and the inner surface of said well casing.

5. A perforating gun for generating one or more perforations through a well casing comprising:

a gun housing containing one or more explosive charges, said gun housing having an outer surface having at least one bow spring attached thereto, said bow spring having an outer surface, at least a portion of said outer surface of said bow spring substantially corresponding to an inner surface of said well casing, wherein the at least one bow spring is a sacrificial target through which the one or more explosive charges perforate.

6. The perforating gun of claim 5, wherein said outer surface of said bow spring is for engaging said inner surface of said well casing prior to explosive charge detonation.

7. The perforating gun of claim 5, wherein one or more of said explosive charges are configured to detonate through said outer surface of said bow spring substantially corresponding to said inner surface of said well casing.

8. The perforating gun of claim 5, wherein the at least a portion of said outer surface of said bow spring is adapted to suppress burr formation on said inner surface of said well casing.

9. A method of suppressing burr formation during well casing perforation comprising the steps of:

providing a perforating gun comprising:

a gun housing containing one or more explosive charges, at least a portion of said outer surface of said gun housing substantially corresponding to an inner surface of said well casing;

inserting said gun housing downwardly into said well casing;

positioning said gun housing within said well casing such that said portion of said outer surface of said gun housing substantially corresponding to said inner surface of said well casing is in surface contact with said inner surface of said well casing; and detonating one or more of said explosive charges through said at least a portion of said outer surface of said gun housing in surface contact with said inner surface of said well casing to suppress burr formation.

10. The method of claim 9, wherein the at least a portion of the gun housing outer surface is shaped to enable greater surface contact between the at least a portion of the gun housing outer surface and the inner surface of said well casing.

11. A method of suppressing burr formation during well casing perforation comprising the steps of:

providing a perforating gun comprising:

a gun housing containing one or more explosive charges, said gun housing having an outer surface having at least one bow spring attached thereto, said bow spring having an outer surface, at least a portion of said outer surface of said bow spring substantially corresponding to an inner surface of said well casing;

inserting said gun housing downwardly into said well casing;

positioning said gun housing within said well casing such that said outer surface of said bow spring substantially corresponding to said inner surface of said well casing engages said inner surface of said well casing, one or more of said explosive charges being configured to detonate through said bow spring; and detonating one or more of said explosive charges.

12. The method of claim 11, wherein the at least one bow spring is a sacrificial target through which the one or more explosive charges perforate.

* * * * *